US007726837B2

(12) United States Patent
Ewert

(10) Patent No.: US 7,726,837 B2
(45) Date of Patent: Jun. 1, 2010

(54) SEALED LIGHTING ASSEMBLY EMPLOYING SIDE-EMITTING LENSES

(75) Inventor: Jurgen E. Ewert, Woodstock, VT (US)

(73) Assignee: C-R Control Systems, Inc. NH (US)

( * ) Notice: Subject to any disclaimer, the term of this patent is extended or adjusted under 35 U.S.C. 154(b) by 231 days.

(21) Appl. No.: 12/136,127

(22) Filed: Jun. 10, 2008

(65) Prior Publication Data

US 2009/0175037 A1 Jul. 9, 2009

Related U.S. Application Data

(60) Provisional application No. 61/019,347, filed on Jan. 7, 2008.

(51) Int. Cl.
*F21V 5/04* (2006.01)

(52) U.S. Cl. ..... 362/249.02; 362/255; 362/545; 340/815.45; 340/815.65

(58) Field of Classification Search ..... 362/186, 362/235, 240, 241–246, 249.01, 249.02, 362/249.03, 249.05, 249.06, 249.13, 255, 362/304, 309, 310, 311.05, 326, 329, 332, 362/333, 336, 337, 363, 455, 470, 477, 479, 362/485, 487, 493, 540, 545, 546, 800; 340/473, 340/815.45, 815.65, 908, 908.1, 985
See application file for complete search history.

(56) References Cited

U.S. PATENT DOCUMENTS 4,638,411 A * 1/1987 Trainor ..... 362/145
5,224,773 A * 7/1993 Arimura ..... 362/227
5,230,560 A 7/1993 Lyons
5,335,157 A 8/1994 Lyons
6,099,148 A 8/2000 Northrup et al.
6,483,439 B1 * 11/2002 Vukosic ..... 340/815.65
6,626,557 B1 * 9/2003 Taylor ..... 362/235
7,111,961 B2 9/2006 Trenchard et al.
2006/0250801 A1 11/2006 Trenchard et al.

OTHER PUBLICATIONS

Tideland Signal Corporation, P.O. Box 52430, Houston, TX 77052-2430, "RETRO Flashers LED Replacement Light Source", downloaded from URL: http://www.tidelandsignal.com/web/html/mled-retro.html on Jun. 18, 2008.

* cited by examiner

*Primary Examiner*—Hargobind S Sawhney
(74) *Attorney, Agent, or Firm*—Michael J. Weins; Jeffrey E. Semprebon

(57) ABSTRACT

A lighting assembly employs LED lamps and associated side-emitting lenses that each redirect the light generated by the associated LED lamp to provide a distribution of emitted light substantially normal to an axis of symmetry of the lens. In a basic embodiment, the lighting assembly employs two lenses in a stacked configuration, with one lens being inverted. The lighting assembly has two plates, to which the lenses and LED lamps attach, and the plates are attached together by a cylinder to form a sealed enclosure for the lenses and LED lamps. When increased light intensity is desired, an additional plate and cylinder can be added to form an additional enclosure, housing additional LED lamps and lenses. Further enclosures can be formed by additional plates and cylinders.

17 Claims, 4 Drawing Sheets

SEALED LIGHTING ASSEMBLY EMPLOYING SIDE-EMITTING LENSES

FIELD OF THE INVENTION

The present invention relates to a lighting assembly that employs side-emitting lenses that redirect the light emitted by a source such as an LED to provide a distribution of light that is substantially symmetrical about an axis, and more particularly relates to a lighting assembly that is well suited for use in a luminaire intended for marine applications marking buoys and similar objects.

BACKGROUND OF THE INVENTION

Luminaires have long been employed for marking objects of navigational interest, such as buoys and fixed obstructions. These luminaires are typically designed to emit light in a in a relatively narrow band about the horizontal plane to increase their efficiency by causing the light generated to be concentrated in the generally horizontal region where viewers are most likely to be located. This desired horizontal distribution has classically been attained by using cylindrical Fresnel lenses surrounding a centrally-located lamp, such as taught in U.S. Pat. No. 6,099,148. While such lenses can concentrate a large portion of light emitted from a lamp into a substantially horizontal distribution, those portions of the light which are directed substantially vertically upward or downward will not enter such lenses, and thus are wasted. To avoid the loss of these substantially vertically-directed portions of the light, U.S. Pat. Nos. 5,230,560 and 5,335,157 teach the use of reflectors to redirect these portions of the light in a substantially horizontal direction in order to provide greater efficiency for the luminaire. Since luminaires for marking obstructions are frequently employed at remote locations, such as on buoys, it is desirable for such luminaires to employ LED's to generate light. LED's provide advantages of reliability, long useful life, and relatively low power consumption, reducing the size of batteries needed for power at such remote locations.

One approach to providing an LED-powered luminaire has been to employ an LED lighting element in combination with a conventional cylindrical Fresnel lens, with the LED lighting element replacing the incandescent lamp that is typically employed with such lenses. One such luminaire is taught in U.S. Pat. No. 7,111,961 of Automatic Power, Inc., which teaches the use of multiple LED's in vertically stacked outward-facing radial arrays, in combination with a diffuser that surrounds the LED's to provide greater uniformity in the distribution of the emitted light about the vertical axis.

A more recent application of Automatic Power, Inc., Publication No. 2007/0223230, seeks to eliminate the use of a diffuser and provide greater heat-dissipating capacity to allow the use of higher power LEDs by employing an assembly of a pair of opposed high-flux LEDs, having a pair of trapezoidal lenses therebetween which form part of a central core, to which is attached a pair of heat sinks attaching to the LEDs. This unit, in combination with a removable supplemental heat sink, provide a fixture for holding an optional clear cylindrical cover. This lighting assembly provides a quasi point source of light, which is taught as providing a point source distribution of light at least through the spherical coordinates for the angles of admission of the Fresnel lens. If additional light intensity is to be provided, the '230 publication suggests that multiple assemblies be employed. However, if such is done, there would be multiple point sources spaced apart, and thus the emitted light could not be effectively collimated by the Fresnel lens, limiting the efficiency of the luminaire.

SUMMARY OF THE INVENTION

The present invention relates to a lighting assembly that employs LED lamps and side-emitting lenses suitable for use in situations that require a distribution of light that is substantially directed in a narrow band that is centered on a plane normal to a central axis of the lighting assembly; typically, the lighting assembly is positioned with this central axis vertical when in service, so that the emitted light is restricted to a substantially horizontal band about the vertical central axis. The lighting assembly employs multiple LED lamps and associated lenses to obtain a desired intensity of emitted light, and provides a sealed enclosure for the LED lamps and the lenses, making the resulting lighting assembly especially well-suited for use in a luminaire intended for use in harsh environments.

The lighting assembly is well suited for incorporation into a luminaire having a luminaire power housing and a power system residing therein that provides electrical power for the lighting assembly. For marine applications, such luminaires frequently have the power system employ batteries that are recharged by photovoltaic panels attached thereto. When employed in a battery-powered luminaire, it is especially desirable for the lighting assembly to provide a very high degree of efficiency to reduce the battery power required.

The lighting assembly has a first plate which serves as a base plate, having a base plate upper face and a base plate lower face. The base plate has a base plate axis, which serves as a central axis for the lighting assembly and which is typically vertical when the lighting assembly is in service. The base plate is configured so as to leave at least a portion thereof exposed to the environment in which the lighting assembly resides when the lighting assembly is in service. Typically, the lighting assembly is attached to a luminaire power housing. The base plate can be attached directly to the luminaire power housing; in one embodiment, the base plate is provided with an array of base mounting passages therethrough, through which fasteners such as bolts can pass to affix the base plate onto the luminaire power housing with the base plate lower face against a portion of the luminaire power housing.

The base plate serves as a heat sink for a first LED lamp that is mounted thereto, and should be formed of a highly thermally conductive material such as aluminum. The first LED lamp is mounted onto the base plate upper face in such a manner and is so configured that the light generated by the first LED lamp is symmetrically distributed with respect to the base plate axis.

A first side-emitting lens is also attached to the base plate upper face. The first side-emitting lens is symmetrically disposed about a first lens central axis. The first side-emitting lens is designed such that, when the first LED is positioned at a centering point CP on the first lens central axis, the first side-emitting lens receives the light generated by the first LED lamp and redirects this light such that the light is emitted from the first side-emitting lens in a direction substantially normal to the first lens central axis. Typically, the first side-emitting lens has a cavity in which the first LED resides. One side-emitting lens offering an extremely high degree of efficiency in providing such a distribution of light is taught in co-pending application Ser. No. 11/943,743.

Base plate alignment means can be provided to align the first side-emitting lens when it is mounted onto the base plate such that the first lens central axis aligns with the base plate axis. Attaching the first side-emitting lens to the base plate and providing alignment means facilitates fabrication of the lighting assembly by guiding the first side-emitting lens into proper alignment with respect to the first LED lamp which is also mounted to the base plate, and avoids the need to align the first side-emitting lens after assembly. The alignment means can be provided by aligned mounting passages for fasteners that secure the first side-emitting lens to the base plate, but for greater convenience in assembly, the alignment means can be provided by an indent, ledge, or similar structure on the base plate upper face that engages the first side-emitting lens to align it before it is secured to the base plate. The first side-emitting lens can be provided with a first lens mounting flange which serves both to align the first side-emitting lens with the base plate and to engage fasteners employed to secure the first side-emitting lens to the base plate. Alternately, the first side-emitting lens could be attached to the base plate by an adhesive.

The lighting assembly has a second plate, which is spaced apart from the base plate and has a second plate axis, a second plate upper face, and a second plate lower face. Again, the second plate should be made of a thermally conductive material such as aluminum.

To provide greater light intensity than can be supplied by the first LED lamp, a second LED lamp is mounted to the second plate lower face, and is configured and mounted such that the light generated by the second LED lamp is symmetrically distributed with respect to the second plate axis.

A second side-emitting lens is mounted onto the second plate lower face, the second side-emitting lens having a second lens central axis and being configured to redirect light generated by the second LED lamp in such a manner that the light is emitted from the second side-emitting lens in a direction substantially normal to the second lens central axis. Again, the second side-emitting lens typically has a cavity in which the second LED resides. Second plate alignment means can be provided for aligning the second lens central axis with the second plate axis to facilitate fabrication; again, such means can be provided by a second lens mounting flange on the second side-emitting lens that guidably engages a structure such as a ledge or indent on the second plate lower face.

A cylindrical sheath of an optically transmissive material (i.e., either transparent or translucent) is sealably attached to the base plate upper face at a cylinder lower end and to the second plate lower face at a cylinder upper end. When sealably attached, the cylindrical sheath, the base plate, and the second plate form an enclosure in which the LED lamps and the lenses reside, while leaving a substantial portion of the base plate and the second plate exposed to the environment in which the lighting assembly resides. The attachment of the cylindrical sheath to the base plate and to the second plate also serves to index the relative positions of the first side-emitting lens and the second side-emitting lens. The lenses should be aligned such that their central axes are either parallel or coincident.

As noted, the cylindrical sheath is non-opaque. For many applications, and particularly for use in a marker luminaire, the cylindrical sheath is transparent so as to allow the light emitted from the first and second lenses to be transmitted therethrough without significant changes in the distribution of this emitted light.

It should be noted that, when the second plate is attached to the cylindrical sheath, the second LED lamp and the second side-emitting lens are inverted compared to the first LED lamp and the first side-emitting lens. For applications which require the lighting assembly to provide a distribution of light which is vertically symmetrical with respect to the horizontal plane, inverting the second side-emitting lens allows the use of lenses which do not individually provide a distribution of emitted light that is vertically symmetrical, since the inverted orientation of the second side-emitting lens relative to the first side-emitting lens can compensate for the vertical asymmetry of the light emitted individually by each of the lenses. While the distribution of emitted light from each lens need not be vertically symmetrical, it is preferred to employ lenses such as taught in copending application Ser. No. 11/943,743, which can be designed to provide a vertically symmetrical distribution of light with a smaller variance in the off-horizontal component, and which will handle larger LED lamps, since these lenses also have advantages of being able to provide high efficiency lenses that, in and of themselves, redirect the light in a very narrow band, and which are designed to be readily fabricated in an economical manner.

If the radial distribution of the light generated by each of the LED lamps is not radially uniform about the axis of the plate to which the LED lamp is mounted, then the LED lamps should be rotated with respect to each other about the base plate axis so that the net integrated effect will maximize the resulting angular uniformity of the emitted light.

The second plate axis can be aligned with the base plate axis by annular grooves in the base plate upper face and in the second plate lower face that are configured to engage the ends of the cylindrical sheath, these annular grooves being respectively centered about the base plate axis and the second plate axis. Again, providing structures to align the elements facilitates fabrication of the lighting assembly.

To provide power to the first LED lamp and the second LED lamp, a combination of passages and channels in the base plate and the lenses can be employed to allow power leads to pass through the base plate and to reach the first LED lamp and the second LED lamp.

The structure described above can provide the entire lighting assembly, when the light intensity requirements are such that only two LED lamps and associated lenses are required. In such cases, the second plate is formed as a cap plate which seals the top of the lighting assembly, having no through passages. Since the lighting assembly is typically employed when mounted to a luminaire power housing so as to be exposed to the surrounding outdoor environment, the cap plate is typically also configured to shed rain or snow, and may be provided with a spike or other structure to discourage birds from perching on the resulting luminaire, which could result in obstruction of the emitted light by bird droppings, and/or from nesting thereon, which might adversely affect the heat dissipating capacity of the cap plate.

When additional light intensity is required, the lighting assembly can be provided with one or more additional LED lamps and side-emitting lenses. In this situation, the second plate is formed as an intermediate heat sink plate that is designed to have an additional cylindrical sheath attached to the second plate upper face. The second plate is configured such that, when the cylindrical sheaths are attached thereto, a peripheral rim of the second plate remains exposed to the outdoor environment in which the lighting assembly resides. An additional plate can then attach to the other end of the second clear cylindrical sheath, thereby forming a second enclosure in which one or two additional LED lamps and associated lenses can be housed. Regardless of how many LED lamps and lenses are stacked, each LED lamp will be mounted to a plate which is exposed to the environment in which the lighting assembly resides so as to serve as a heat sink to effectively dissipate heat generated by the LED lamp(s) attached thereto. Where an intermediate plate is employed that has an LED lamp mounted on both its upper and lower faces, it is preferred for the intermediate plate to be provided with radiating fins to increase its ability to dissipate heat.

It should be appreciated that the stacked structure can provide additional enclosures for LED lamps and lenses to increase the power of the lighting assembly. When stacked, the effect of shadowing caused by the wiring between the LED lamps can be minimized by wiring the LED lamps in series or, alternatively, by daisy chaining the LED lamps together. Since the light from each LED lamp is individually redirected by its associated side-emitting lens, stacking additional LED lamps to provide additional light output does not adversely affect the efficiency of a luminaire that incorporates the lighting assembly, as occurs with luminaires that employ a Fresnel lens to direct the light. Furthermore, since each LED lamp is mounted to a thermally conductive plate that is exposed to the surrounding environment, stacking of additional LED lamps does not create additional problems removing excess generated heat.

BRIEF DESCRIPTION OF THE FIGURES

FIG. 4 also shows a number of fasteners and a gasket that are employed to sealably mount the lighting assembly atop a luminaire power housing, only a portion of which is shown.

DETAILED DESCRIPTION OF THE PREFERRED EMBODIMENTS

Figure 1:
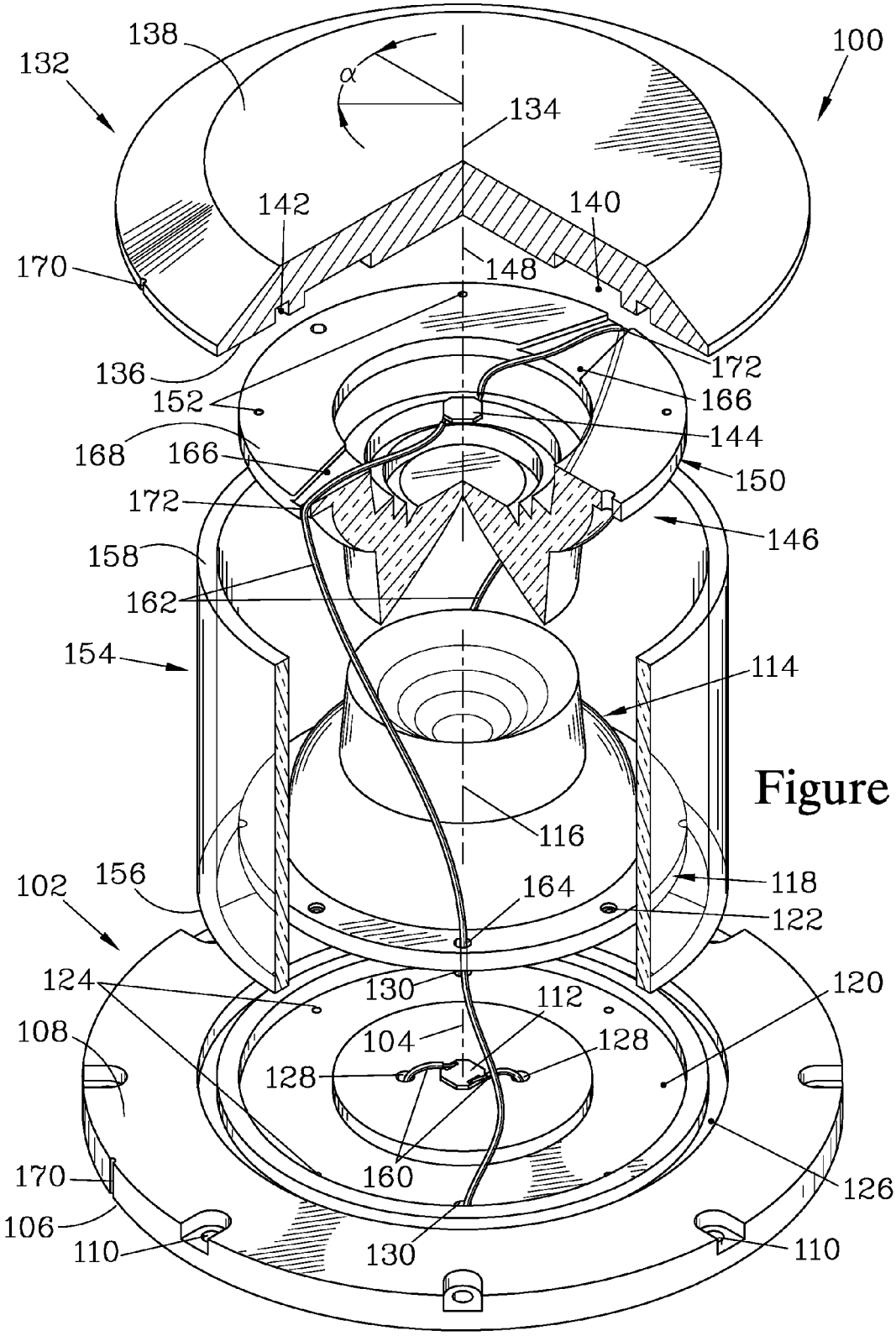
FIG. 1 is a partially-sectioned exploded isometric view of a lighting assembly designed for incorporation into a luminaire, where the lighting assembly employs a pair of LED lamps and associated side-emitting lenses. The lighting assembly has a base plate, a transparent cylindrical sheath, and a second plate which combine to form an enclosure for protecting the LED lamps and the lenses. The plates extend beyond the enclosed space to serve as effective heat sinks for the LED lamps, which are each mounted to one of the plates. The lighting assembly can be readily assembled with the lens elements aligned along a common axis. Because one of the LED lamps and its associated lens are mounted in an inverted position relative to the other, the lighting assembly can provide an overall distribution of light that is vertically symmetrical while employing lenses which do not individually provide a vertically symmetrical distribution of emitted light.

FIG. 1 is an exploded view that illustrates a lighting assembly 100 that forms one embodiment of the present invention. The lighting assembly 100 has a first plate 102 which serves as a base plate, and which is formed of a highly thermally conductive material, such as aluminum. When the lighting assembly 100 is intended for use in a corrosive environment, such as a marine environment, appropriate treatment such as anodization can provide the base plate 102 with resistance to corrosion. The base plate 102 has a base plate axis 104, a base plate lower face 106, and a base plate upper face 108. The base plate 102 is designed for attaching to a luminaire power housing (not shown), and has an array of base mounting passages 110, through which fasteners such as screws or bolts can pass to secure the base plate 102 to the luminaire power housing. An appropriate sealant or gasket can be employed to seal the base plate lower face 106 against the luminaire power housing, as discussed below in the description of FIG. 4.

A first LED lamp 112 attaches to the base plate upper face 108. The first LED lamp 112 generates a distribution of light that is symmetrical with respect to the base plate axis 104. In this embodiment, the first LED lamp 112 is illustrated as being generally square in overall shape, providing a distribution of light having four radial lobes of increased intensity. It should be appreciated that other shapes could be employed.

A first side-emitting lens 114 having a first lens central axis 116 also attaches to the base plate upper face 108. In this embodiment, the first side-emitting lens 114 is formed with a first lens mounting flange 118, and the base plate upper face 108 has a base plate annular indent 120 configured to guidably accept the first lens mounting flange 118. The first lens mounting flange 118 also has an array of first flange fastener passages 122 therethrough, and the base plate upper face 108 has a corresponding arrangement of base plate fastener receptors 124 into which fasteners such as screws can be engaged to secure the first side-emitting lens 114 to the base plate upper face 108. The base plate annular indent 120 is symmetrical about the base plate axis 104, and guidably engages the first lens mounting flange 118 so as to provide base plate alignment means for aligning the first lens central axis 116 with the base plate axis 104. While such alignment means could be provided by the first flange fastener passages 122 and the base plate fastener receptors 124, the use of the base plate annular indent 120 and the first lens mounting flange 118 facilitates assembly of the lighting assembly 100, as it allows the first side-emitting lens 114 to be positively positioned on the base plate upper face 108 before attaching it thereto with fasteners, thereby facilitating fabrication of the lighting assembly 100. This also allows the flange fastener passages 122 to be somewhat oversized, further facilitating fabrication.

The base plate upper face 108 is provided with a base plate annular groove 126 which is symmetrical about the base plate axis 104, while the base plate 102 is provided with a first pair of base wire passages 128 and a second pair of base wire passages 130 which pass between the base plate upper face 108 and the base plate lower face 106. The functions of the base plate annular groove 126 and the additional passages (128, 130) in the base plate 102 are discussed below.

A second plate 132 is spaced apart from the base plate 102, and in this embodiment is formed as a cap plate having no passages therethrough. Again, the second plate 132 should be formed from a highly thermally conductive material, such as aluminum. The second plate 132 has a second plate axis 134, a second plate lower face 136, and a second plate upper face 138. The second plate lower face 136 has similar features to the base plate upper face 108, but inverted, having an array of second plate fastener receptors (not shown) and having a second plate annular indent 140 and a second plate annular groove 142 that are both symmetrical about the second plate axis 134.

A second LED lamp 144 attaches to the second plate lower face 136, and again generates a distribution of light that is symmetrical with respect to the second plate axis 134. Like the first LED lamp 112, in this embodiment the second LED lamp 144 is generally square in shape and generates a distribution of light having four radial lobes of increased intensity.

A second side-emitting lens 146 having a second lens central axis 148 attaches to the second plate lower face 136. The second side-emitting lens 146 has a second lens mounting flange 150 that indexes on the second plate annular indent 140 to provide second plate alignment means for aligning the second lens central axis 148 with the second plate axis 134. The second lens mounting flange 150 again has an array of second flange fastener passages 152 therethrough, which align with corresponding second plate fastener receptors (not shown) to allow the second side-emitting lens 146 to be affixed to the second plate lower face 136 by conventional fasteners.

To form a sealed enclosure for the LED lamps (112, 144) and the lenses (114, 146), the base plate 102 and the second plate 132 are sealably attached to a transparent cylindrical sheath 154 that terminates at a cylinder lower end 156 and a cylinder upper end 158. It is generally preferred for the cylindrical sheath 154 to be clear; if the lighting assembly 100 is to provide colored light, such as when the lighting assembly 100 is designed to be part of a buoy light, such color can be provided by employing colored LED lamps (112, 144). While the cylindrical sheath 154 in such cases could be colored, the color of the cylindrical sheath 154 would need to be closely matched to the LED color if inefficiency is to be avoided.

In this embodiment, the base plate annular groove 126 is configured to guidably accept the cylinder lower end 156, and the second plate annular groove 142 is configured to guidably accept the cylinder upper end 158. Since the annular grooves (126, 142) are each symmetrical about the plate axis (104, 134) of their associated plates (102, 132), the annular grooves (126, 142) and the cylindrical sheath 154 serve to align the second plate axis 134 with the base plate axis 104. The annular grooves (126, 142) in this embodiment also provide a greater region of contact between the cylindrical sheath 154 and the plates (102, 132), providing a better seal when the cylindrical sheath 154 is attached to the base plate upper face 108 and to the second plate lower face 136 by adhesive. When an appropriate adhesive/sealant is employed, the base plate 102, the cylindrical sheath 154, and the second plate 132 form a sealed enclosure for housing the lenses (114, 146) and the LED lamps (112, 144) to protect these elements from the surrounding open environment. Such environmental factors can include high humidity, salt water spray (in marine environments), presence of hydrocarbons (in oil drilling platforms, refineries, and similar oil-processing facilities), etc. When the adhesive/sealant is selected to be resistant to the anticipated environmental factors, the resulting sealed structure makes the lighting assembly 100 particularly well suited for marker luminaires used in harsh environments such as marine environments or on oil-processing facilities. Alternative schemes for attachment of a cylindrical sheath to base and second plates could be employed; for example, the ends of the cylindrical sheath could be threaded to engage matching threads provided in the annular grooves of the base plate and the second plate.

The effectiveness of the base plate 102 in acting as a heat sink for the first LED lamp 112 is enhanced by the fact that it extends beyond the enclosed space created by the base plate 102, the cylindrical sheath 154, and the second plate 132, such that a substantial portion of the base plate 102 is exposed to the outside air. The second plate 132 in this embodiment has the second plate upper face 138 exposed to the surrounding environment, and thus provides an effective heat sink for the second LED lamp 144.

When assembled, the lighting assembly 100 has the second LED lamp 144 and the second side-emitting lens 146 mounted in an inverted position compared to the first LED lamp 112 and the first side-emitting lens 114. In the embodiment illustrated, the lenses (114, 146) are lenses which can individually provide a vertically symmetrical distribution of light with respect to the horizontal plane; such lenses are taught in co-pending application Ser. No. 11/943,743. In addition to providing a vertically symmetrical light output, the lenses of the '743 application provide a high degree of efficiency and are designed to be economically fabricated. However, it should be noted that the inversion of the second LED lamp and the second lens allows the use of lenses which do not individually provide a distribution of emitted light that is vertically symmetrical with respect to the horizontal plane, since the inversion of the second lens with respect to the first side-emitting lens will compensate for the vertical asymmetry in the distribution of the individual lenses. One example of a lighting assembly employing such lenses is discussed below with regard to FIG. 3.

To provide power to the first LED lamp 112 and the second LED lamp 144 in this embodiment, a first pair of power leads 160 and a second pair of power leads 162 can be passed from the luminaire power housing through the first pair of base wire passages 128 and the second pair of base wire passages 130, which pass between the base plate lower face 106 and the base plate upper face 108. These base wire passages (128, 130) allow the power leads (160, 162) to pass from the luminaire power housing through the base plate 102 into the enclosure formed by the base plate 102, the cylindrical sheath 154, and the second plate 132. The first pair of power leads 160 connect directly to the first LED lamp 112.

The second pair of power leads 162 connect to the second LED lamp 144, but must first pass the first side-emitting lens 114 and the second side-emitting lens 146. The first lens mounting flange 118 of the first side-emitting lens 114 is provided with a pair of first flange wire passages 164 (only one of which is visible in FIG. 1) which are aligned with the second pair of base wire passages 130 to provide passage through the first lens mounting flange 118, while the second lens mounting flange 150 is provided with a pair of second flange channels 166 in a second flange mounting surface 168 that mates against the second plate annular indent 140. The second flange channels 166 allow the second pair of power leads 162 to pass between the second lens mounting flange 150 and the second plate lower face 136 to connect to the second LED lamp 144. While not needed, the second lens mounting flange 150 could also be provided with second flange wire passages and the first lens mounting flange 118 could be provided with first flange channels, allowing the first side-emitting lens 114 and the second side-emitting lens 146 to be identical in configuration, thereby reducing the number of different parts needed to fabricate the lighting assembly 100. It should be noted that the second flange channels 166 should be sufficiently deep that the second pair of power leads 162 can pass between the second lens mounting flange 150 and the second plate lower face 136 even when the second lens mounting flange 150 is recessed slightly in the second plate annular indent 140.

To reduce the effect of shadows caused by the second pair of power leads 162, they should spiral slightly as they pass from the first flange wire passages 164 to the second flange channels 166, thereby reducing the effect of shadowing in any particular radial direction, and improving the angular uniformity of the light emitted from the lighting assembly 100 about the plate axes (104, 134).

To further enhance the angular uniformity, it is preferred for the LED lamps (112, 144) to be slightly rotated with respect to each other about the plate axes (104, 134) so as to reduce the effect of non-uniformity in the output of light that each of the LED lamps (112, 144) generates. In this embodiment, where the LED lamps (112, 144) are generally square, they each generate a light output with four radial lobes of increased intensity. To offset these lobes, the second plate 132 is twisted with respect to the base plate 102 when the lighting assembly 100 is assembled, such that the second LED lamp 144 is rotated about the plate axes (104, 134) by an angle $\alpha$ relative to the first LED lamp 112, where the angle $\alpha$ measures 45°.

It should be appreciated by one skilled in the art that the angle $\alpha$ defining the degree of offset in such situations will depend on the radial distribution of light generated by the particular LED lamps employed. For example, if hexagonal LED lamps are employed, each emitting a distribution of light with six radial lobes, the LED lamps would be offset by an angle of 30°, and if oval LED lamps are employed, each emitting a distribution of light with two lobes, then the LED lamps would be offset by an angle of 90° with respect to each other. In general, where the radial light distribution of the LED lamps employed is such as to create N radial lobes, the angle $\alpha$ is selected to be 360/2N when measured in degrees.

To facilitate the correct relative orientation of the base plate 102 and the second plate 132 when the lighting assembly 100 is assembled, indexing notches 170 are preferably provided on the base plate 102 and the second plate 132. These indexing notches 170 are positioned so as to be aligned with each other when the base plate 102 and the second plate 132 are at the proper orientation with respect to each other to achieve the desired angular offset of the LED lamps (112, 144). When the lighting assembly 100 is assembled, engagement of the cylindrical sheath 154 with the annular grooves (126, 142) allows rotating the plates (102, 132) relative to each other about the plate axes (104, 134) to align the index notches 170 while maintaining these axes (104, 134) in alignment. The mounting of the first side-emitting lens 114 to the base plate upper face 108 and of the second side-emitting lens 146 to the second plate lower face 136 can be such that aligning the index notches 170 also provides an appropriate twist to the second pair of power leads 162 to form spirals that reduce the effects of shadowing. This twist can be better controlled when the second lens mounting flange 150 is provided with wire-retaining notches 172 that engage the second pair of power leads 162 as they exit from the second flange channels 166. Again, while not needed, the first lens mounting flange 118 can be similarly configured to allow the use of common parts.

Figure 2:
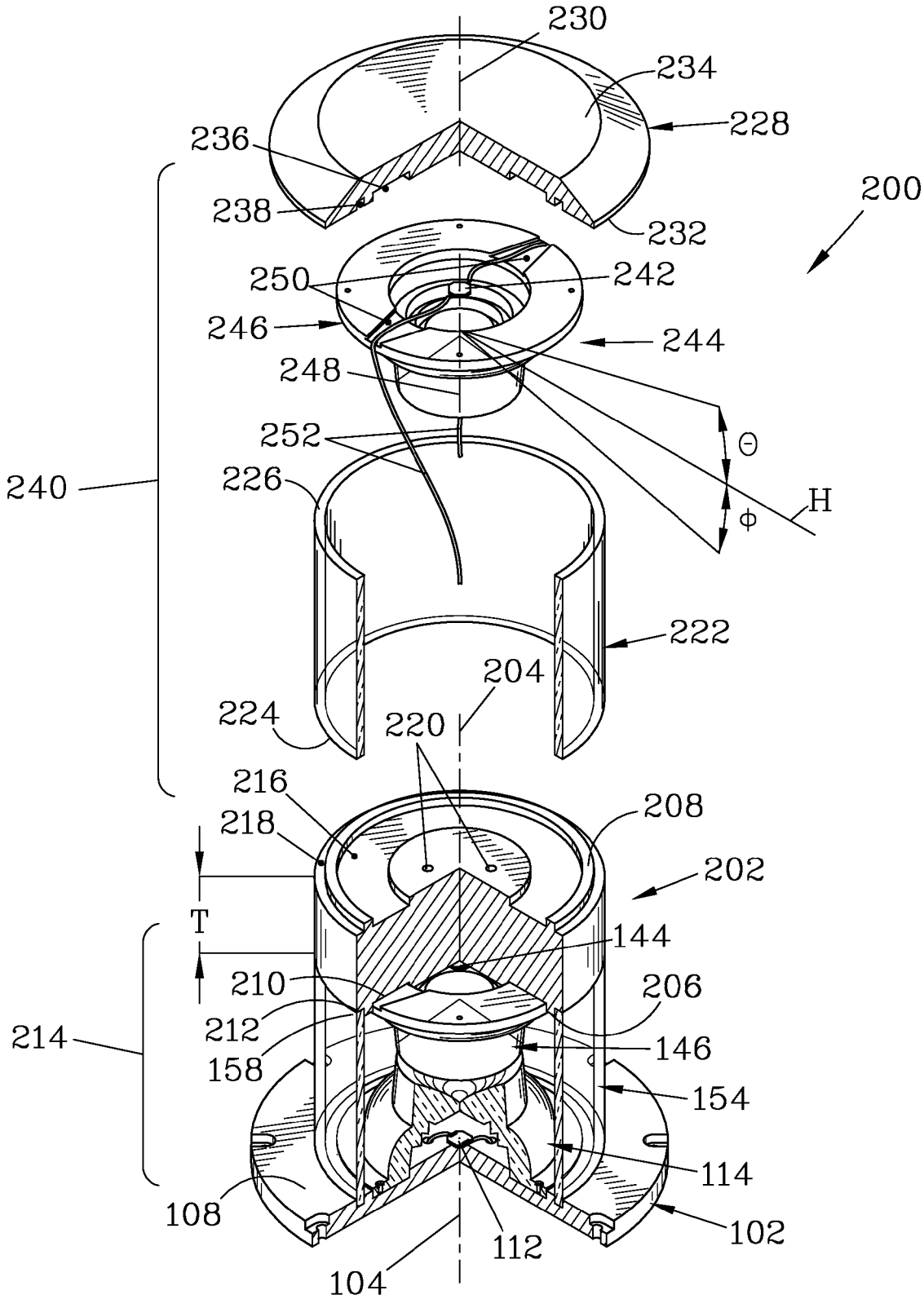
FIG. 2 is a partially exploded isometric view of another lighting assembly of the present invention, which designed for use as part of a luminaire requiring a greater intensity of light than can be provided by the lighting assembly shown in FIG. 1. This lighting assembly, in addition to using a pair of LED lamps and associated lenses similar to those shown in FIG. 1, also employs a third LED lamp and associated lens that are spaced apart from the first pair of lamps and lenses and are aligned therewith along a vertical axis. The third LED lamp is housed in a second enclosure, where the second enclosure is formed by a cap plate and a second transparent cylindrical sheath, in combination with the second plate that also forms a part of the first enclosure. The third LED lamp is mounted to the cap plate, which provides an effective heat sink with a significant portion of its surface exposed to the surrounding open environment.
Figure 3:
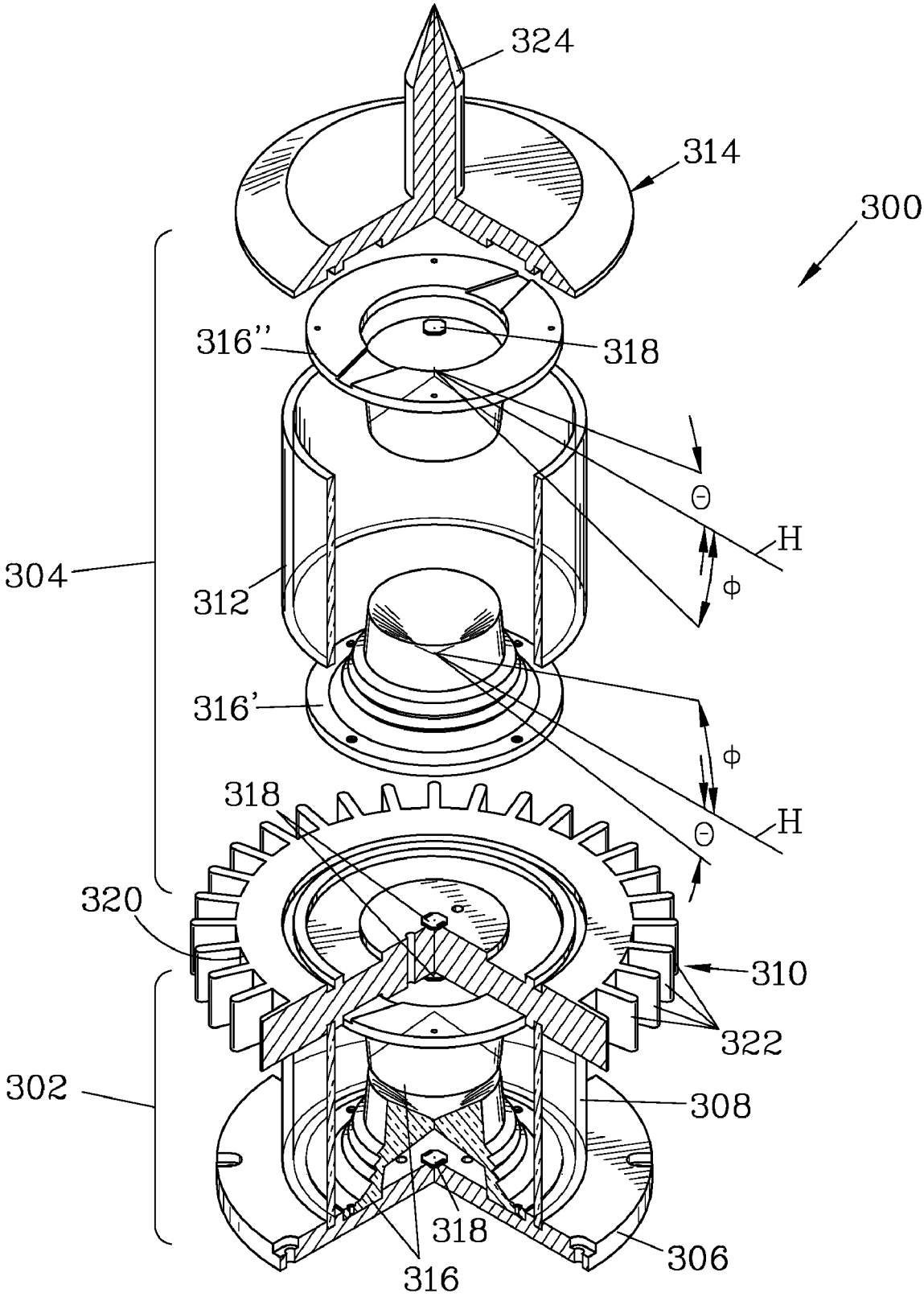
FIG. 3 is a partially exploded view of another embodiment of the invention, which is for a lighting assembly that provides greater light intensity than the embodiment shown in FIG. 2. In this embodiment, a second pair of LED lamps is provided in a second enclosure, which places a heavier heat load on a second plate which lies between the enclosed spaces and has two of the LED lamps mounted thereto. To compensate for the additional heat load, this second plate is provided with fins to increase its heat dissipating capacity. Similarly to the lighting assembly shown in FIG. 1, this lighting assembly can employ lenses where the vertical distribution of the light is asymmetric with respect to the horizontal plane and still maintain an overall light output which is symmetrically disposed with respect to the horizontal plane, since the lenses are arranged in pairs with one lens of each pair inverted relative to the other.
Figure 4:
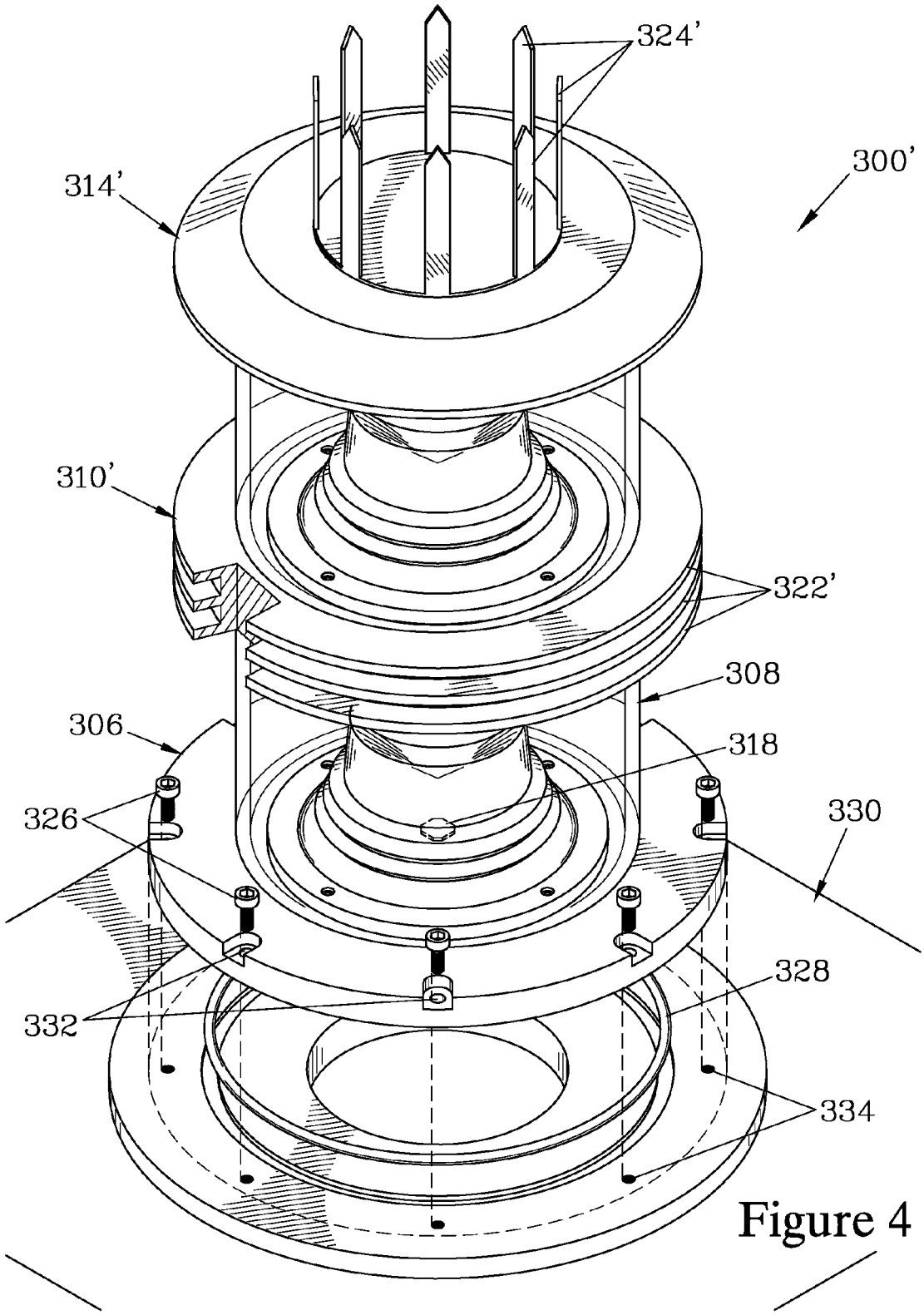
FIG. 4 is an isometric illustration of an assembled lighting assembly which forms another embodiment of the present invention, which again provides a stacked configuration to accommodate three or four LED lamps and lenses. In this embodiment, the intermediate heat sink is provided with radiating fins that are horizontal, making them easier to fabricate and less prone to breakage.

When greater light intensity is desired than can be provided by a pair of LED lamps, such increased intensity can be provided by stacking additional LED lamps and lenses, as shown in FIGS. 2-4. FIG. 2 illustrates a lighting assembly 200 which employs several of the same elements as are employed in the lighting assembly 100, including the base plate 102, the first and second LED lamps (112, 144), the first and second side-emitting lenses (114, 146) and the cylindrical sheath 154.

The lighting assembly 200 employs a second plate 202 which combines with the base plate 102 and the cylindrical sheath 154 to form an enclosed space for the first LED lamp 112, the second LED lamp 144, and their associated lenses (114, 146). The second plate 202 of this embodiment not only serves as a terminating surface for the enclosure holding the first and second LED lamps (112, 144), but also serves as a base for the structure that resides above, and thus the second plate 202 is formed as an intermediate heat sink plate, rather than as a cap plate. The second plate 202 has a second plate axis 204, a second plate lower face 206, and a second plate upper face 208. The second plate lower face 206 has a second plate lower annular indent 210 and a second plate lower annular groove 212, both of which are symmetrical about the second plate axis 204. The second plate lower annular indent 210 serves to align the second side-emitting lens 146 with the second plate axis 204, while the second plate lower annular groove 212 engages the cylinder upper end 158 to align the second plate axis 204 with the base plate axis 104. When the second plate 202 is sealed to the cylinder upper end 158, the base plate 102, the cylindrical sheath 154, and the second plate 202 form a sealed lower enclosure 214 for housing the first and second LED lamps (112, 144) and the first and second side-emitting lenses (114, 146). In the lighting assembly 200, the second LED lamp 144 and the second side-emitting lens 146 are mounted to the second plate lower face 206 in the same manner as they are attached to the second plate lower face 136 in the lighting assembly 100 discussed above.

The second plate upper face 208 is preferably formed as a mirror image of the second plate lower face 206, having a second plate upper annular indent 216 and a second plate upper annular groove 218. While the second plate upper annular indent 216 is not needed for the 3-lens embodiment shown, it is desirable for allowing the same second plate 202 to be employed in a 4-lens embodiment, such as those discussed below and shown in FIGS. 3 and 4. The second plate 202 also has one or more second plate wire passages 220 therethrough, extending between the second plate lower face 206 and the second plate upper face 208.

An upper cylindrical sheath 222 is provided, terminating in an upper cylinder lower end 224 and an upper cylinder upper end 226. The upper cylinder lower end 224 guidably engages the second plate upper annular groove 218, and is sealably affixed to the second plate upper face 208 in a manner similar to the attachment of the cylindrical sheath 154 to the base plate upper face 108. While the second plate 202 of this embodiment has a diameter matching that of the cylindrical sheaths (154, 222), the second plate 202 has an appreciable thickness T providing a substantial surface area of the second plate 202 that is exposed to the surrounding environment, and thus provides a substantial cooling surface through which heat can be dissipated. This allows the second plate 202 to serve as an effective heat sink for the second LED lamp 144 that is mounted thereon. The heat sinking ability of the second plate 202 could be enhanced by providing radiating fins, as discussed below and as shown in FIGS. 3 and 4.

The lighting assembly 200 also has a cap plate 228, which can be identical in configuration to the second plate 132 of the lighting assembly 100 shown in FIG. 1. The cap plate 228 has a cap plate axis 230, a cap plate lower face 232, and a cap plate upper face 234. The cap plate lower face 232 has a cap plate annular indent 236 and a cap plate annular groove 238, both of which are symmetrical about the cap plate axis 230. The cap plate annular groove 238 is configured to guidably engage the upper cylinder upper end 226 of the upper cylindrical sheath 222, in the same manner that the second plate lower annular groove 212 on the second plate lower face 206 engages the cylinder upper end 158 of the cylindrical sheath 154, and in this manner the cap plate axis 230 is aligned with the second plate axis 204 and with the base plate axis 104 when the lighting assembly 200 is assembled.

When the cap plate lower face 232 is sealed to the upper cylinder upper end 226, it forms an upper enclosure 240 in combination with the second plate 202 and the upper cylindrical sheath 222. This upper enclosure 240 can house either one or a pair of additional LED lamps and associated lenses. In the lighting assembly 200 illustrated, only a single upper section LED lamp 242 and an associated upper section lens 244 are employed. When only a single LED lamp 242 and associated lens 244 are employed in the upper enclosure 240 for an application where a vertically symmetrical distribution of emitted light is desired, the upper section lens 244 should be designed to provide an individual vertical distribution of light that is symmetrical with respect to the horizontal plane. As illustrated in FIG. 2 for the upper section lens 244, each of the lenses (114, 146, 244) employed in this embodiment individually provides a distribution of light through an angle Θ above the horizontal plane (represented by the line H) that is equal to the distribution of light through an equal angle Φ below the horizontal plane H. Such a vertically symmetrical distribution of light can be provided by side-emitting lenses such as taught in the Ser. No. 11/943,743 application.

In the lighting assembly 200, both the second plate upper face 208 and the cap plate lower face 232 are configured to allow mounting the upper section LED lamp 242 and the upper section lens 244 thereto, allowing an additional upper section LED lamp and an associated lens to be added for situations requiring even greater intensity, without requiring alteration of these elements. However, when only the single upper section LED lamp 242 and associated upper section lens 244 are employed, as illustrated, it is preferred for them to be mounted to the cap plate lower face 232, in which case the cap plate annular indent 236 engages an upper section lens mounting flange 246 to align an upper section lens central axis 248 of the upper section lens 244 with the cap plate axis 230. Mounting the upper section LED lamp 242 to the cap plate 228 results in each of the plates (102, 202, 228) having only a single LED lamp (112, 144, 242) mounted thereto, limiting the requirements of each of the plates (102, 202, 228) to dissipate heat generated by the LED lamps (112, 144, 242). In situations where two upper section LED lamps and lenses are to be employed, the second plate 202 will have two LED lamps mounted thereon, and may need to be configured so as to increase its ability to dissipate heat; such a situation is discussed below with regard to FIGS. 3 and 4.

The upper section lens 244 is preferably identical in configuration to the first and second side-emitting lenses (112, 144), with the upper section lens mounting flange 246 provided with upper section flange channels 250 that allow passage for a pair of upper section power leads 252 that connect to the upper section LED lamp 242; these upper section power leads 252 also pass through the second plate wire passages 220. To reduce shadowing in the lower enclosure 214, the LED lamps (112, 144, 242) could be connected in series to reduce the number of power leads needed. Alternatively, the upper section power leads 252 could be "daisy chained" by connecting to the power leads for the upper section LED lamp 242 in close proximity to the second LED lamp 144, rather than passing down through the base plate 102.

FIG. 3 is an isometric view of a lighting assembly 300 which has several features in common with lighting assembly 200 discussed above, having a lower enclosure 302 and an upper enclosure 304. The lower enclosure 302, which is shown assembled, is formed by a base plate 306, a lower section transparent cylindrical sheath 308, and a second plate 310 that forms an intermediate heat sink plate. The upper enclosure 304, which is shown exploded, is formed by the second plate 310, an upper section transparent cylindrical sheath 312, and a cap plate 314. Each of the enclosures (302, 304) has a pair of side-emitting lenses 316 and a pair of LED lamps 318. One side-emitting lens 316 and associated LED lamp 318 are mounted to each of the base plate 306 and the cap plate 314, while the remaining two side-emitting lenses 316 and LED lamps 318 are mounted to the second plate 310.

Since an even number of lenses 316 are employed in pairs in the lighting assembly 300, with one lens 316 of each pair being inverted with respect to the other, the lenses 316 employed in this embodiment need not individually provide a distribution of light which is vertically centered with respect to the horizontal plane to provide an overall vertically symmetrical light distribution from the lighting assembly 300. For example, if the lens 316' emits a distribution of light that has a greater portion of light emitted through an angle Φ above the horizontal plane H than through a narrower angle Θ below the horizontal plane Φ, this vertical asymmetry is compensated for by the light emitted by the inverted lens 316", which has an inverse distribution of light that has a greater portion of light emitted below the horizontal plane H. While the vertical distribution of light individually emitted from each of the lenses 316 need not be vertically symmetrical, it is still important that the distribution be such as to provide a substantial portion of the light directed into the horizontal plane H.

In the lighting assembly 300, the second plate 310 dissipates heat generated by the two LED lamps 318 that are mounted thereto. To enhance the ability of the second plate 310 to dissipate heat, the second plate 310 has a plate rim 320 that is provided with an array of radiating fins 322 that increase the surface area of the second plate 310. In this embodiment, these radiating fins 322 extend vertically; in relatively still air, this configuration should enhance thermal flow of air past the radiating fins 322 to further enhance their ability to dissipate heat.

The cap plate 314 of this embodiment differs from the cap plate 228 discussed above in that it is provided with a protruding cap spike 324. The cap spike 324 is designed to discourage birds from perching on the lighting assembly 300.

FIG. 4 illustrates a lighting assembly 300' which is similar to that shown in FIG. 3, but which differs in the configuration of the second plate 310' and the cap plate 314'. The second plate 310' of this embodiment is formed with radiating fins 322' that extend horizontally. Such radiating fins 322' can be formed by turning the second plate 310' on a lathe, simplifying fabrication, and are less prone to breakage compared to the radiating fins 322 shown in FIG. 3. Such horizontal radiating fins 322' may also provide better heat transfer when the lighting assembly 300' is employed in areas which are frequently exposed to horizontal wind currents, such as most marine environments.

The cap plate 314' of this embodiment has an array of cap spikes 324' which can be cut and bent from sheet stock and then attached to the cap plate 314'; the cap spikes 324' reduce the machining needed to form the cap plate 314' compared to the cap plate 314 shown in FIG. 3.

FIG. 4 also illustrates a series of fasteners 326 and a base plate seal 328 that are employed to sealably mount the base plate 306 to a luminaire power housing 330. In this embodiment, the base plate seal 328 is provided by an O-ring. To mount the lighting assembly 300', the base plate 306 is placed onto the luminaire power housing 330 with the base plate seal 328 interposed therebetween, and then the fasteners 326 are passed through a series of base mounting passages 332 into threaded holes 334 provided in the luminaire power housing 330. The fasteners 326 are then tightened to compress the base plate seal 328 and affix the base plate 306 to the luminaire power housing 330. Since the base plate 306 extends beyond the lower section transparent cylindrical sheath 308, it serves to dissipate heat from the LED lamp 318 mounted thereto without relying on conducting heat to an underlying structure. This allows the luminaire power housing 330 to be fabricated from plastic to reduce the overall weight and improve its resistance to corrosion.

While the novel features of the present invention have been described in terms of particular embodiments and preferred applications, it should be appreciated by one skilled in the art that substitution of materials and modification of details obviously can be made without departing from the spirit of the invention.

What I claim is:

1. A lighting assembly designed for operation while residing in an exposed outdoor environment, the lighting assembly emitting a desired distribution of light about a lighting assembly axis and comprising:

a first plate serving as a base plate having a base plate axis which serves as the lighting assembly axis, a base plate lower face, and a base plate upper face, said base plate being formed from a highly thermally conductive material;

a first LED lamp attaching to said base plate upper face and configured to generate a distribution of light that is symmetrical with respect to the base plate axis;

a first side-emitting lens having a first lens central axis, said first side-emitting lens being attached to said base plate upper face and having a first lens cavity that surrounds said first LED lamp;

a second plate spaced apart from said base plate and having a second plate axis, a second plate upper face, and a second plate lower face, said second plate being formed from a highly thermally conductive material;

a second LED lamp attaching to said second plate lower face and configured to generate a distribution of light that is symmetrical with respect to the second plate axis;

a second side-emitting lens having a second lens central axis, said second side-emitting lens being attached to said second plate lower face and having a second lens cavity that surrounds said second LED lamp;

an optically transmissive cylindrical sheath; and means for sealably attaching said cylindrical sheath to said base plate upper face and to said second plate lower face in such a manner as to enclose said first side-emitting lens and said second side-emitting lens, while leaving a substantial portion of said base plate and said second plate exposed to the environment in which the lighting assembly resides.

2. The lighting assembly of claim 1 wherein said base plate axis and said second plate axis are aligned so as to be parallel when said base plate and said second plate are sealably attached to said cylindrical sheath.

3. The lighting assembly of claim 1 wherein said cylindrical sheath is transparent and terminates at a cylinder lower end and a cylinder upper end, further wherein said means for sealably attaching said cylindrical sheath to said base plate upper face and to said second plate lower face further comprises:

a base plate annular groove on said base plate upper face configured to guidably accept said cylinder lower end, said base plate annular groove being symmetrically disposed about the base plate axis;

a second plate annular groove on said second plate lower face configured to guidably accept said cylinder upper end, said second plate annular groove being symmetrically disposed about the second plate axis, whereby, when said cylindrical sheath is accepted in said annular grooves, said second plate axis is aligned so as to be coincident with said base plate axis; and an adhesive for sealing said cylindrical sheath in said annular grooves.

4. The lighting assembly of claim 3 further comprising:

base plate alignment means associated with said base plate for aligning the first lens central axis with the base plate axis; and second plate alignment means associated with said second plate for aligning the second lens central axis with the second plate axis.

5. The lighting assembly of claim 4 wherein said base plate alignment means further comprises:

a base plate lens-mounting indent configured to guidably accept said first side-emitting lens, said base plate lens-mounting indent being symmetrically disposed about the base plate axis; and further wherein said second plate alignment means further comprises:

a second plate lens-mounting indent configured to guidably accept said second side-emitting lens, said second plate lens-mounting indent being symmetrically disposed about the second plate axis.

6. The lighting assembly of claim 5 wherein said first side-emitting lens further comprises:

a first lens flange configured to guidably engage said base plate lens-mounting indent; and further wherein said second side-emitting lens further comprises:

a second lens flange configured to guidably engage said second plate lens-mounting indent.

7. The lighting assembly of claim 6 further comprising:

at least one first base lead passage extending through said base plate from said base plate lower face to a region of said base plate upper face that is covered by said first side-emitting lens;

at least one second base lead passage extending through said base plate from said base plate lower face to said base plate upper face; and at least one channel in said second side-emitting lens configured to allow access of a power lead to said second LED lamp.

8. The lighting assembly of claim 4 wherein said first LED lamp and said second LED lamp are each configured to provide a radial distribution of light having N lobes, further wherein said base plate and said second plate are rotated with respect to each other such that said first LED lamp and said second LED lamp, that are respectively mounted to said base plate and to said second plate, are rotated with respect to each other by an angle $\alpha$ where:

$$\alpha(\text{degrees})=360/2N.$$

9. The lighting assembly of claim 8 further comprising:

alignment notches on said base plate and said second plate which are aligned when said base plate and said second plate are rotated with respect to each other so as to rotate said first LED lamp with respect to said second LED lamp by the angle $\alpha$.

10. The lighting assembly of claim 1 wherein said second plate is formed by a cap plate.

11. The lighting assembly of claim 1 wherein said second plate is formed by an intermediate heat sink plate, the lighting assembly further comprising:

a cap plate having a cap plate axis and a cap plate lower face, said cap plate being formed from a highly thermally conductive material;

an upper section cylindrical sheath;

means for sealably attaching said upper section cylindrical sheath to said cap plate lower face and to said second plate upper face in such a manner as to form an upper section enclosure while leaving a peripheral rim of said intermediate heat sink plate exposed to the open environment;

at least one upper section LED lamp attaching to one of said cap plate lower face and said second plate upper face and configured to generate a distribution of light that is symmetrical with respect to the cap plate axis and the second plate axis;

at least one upper section side-emitting lens having an upper section lens central axis, said at least one upper section lens being attached to one of said cap plate lower face and said second plate upper face and positioned to receive light from said at least one upper section LED lamp and having an upper section lens cavity that surrounds said upper section LED lamp, said at least one upper section LED lamp and said at least one upper section side-emitting lens residing within said upper section enclosure; and means for providing power from the power housing to said at least one upper section LED lamp.

12. The lighting assembly of claim 11 wherein said peripheral rim is finned.

13. The lighting assembly of claim 12 wherein said fins extend in planes substantially normal to said second plate axis.

14. The lighting assembly of claim 11 further comprising:

base plate alignment means associated with said base plate for aligning the first lens central axis with the base plate axis;

second plate lower face alignment means associated with said second plate lower face for aligning the second plate axis with the second lens central axis; and and at least one of the following:

cap plate alignment means associated with said cap plate for aligning the upper section lens central axis with the cap plate axis; and second plate upper face alignment means associated with said second plate upper face for aligning the upper section lens central axis with the second plate axis.

15. The light assembly of claim 11 wherein said at least one upper section LED lamp further comprises:

a third LED lamp attaching to said cap plate lower face; and further wherein said at least one upper section side-emitting lens further comprises:

a third side-emitting lens that attaches to said cap plate lower face and has a third lens cavity that surrounds said third LED lamp.

16. The light assembly of claim 11 wherein said at least one upper section LED lamp further comprises:

a third LED lamp attaching to said second plate upper face; and further wherein said at least one upper section side-emitting lens further comprises:

a third side-emitting lens that attaches to said second plate upper face and has a third lens cavity that surrounds said third LED lamp.

17. The light assembly of claim 11 wherein said at least one upper section LED lamp further comprises:

a third LED lamp attached to said second plate upper face, and a fourth LED lamp attached to said cap plate lower face; and further wherein said at least one upper section side-emitting lens further comprises:

a third side-emitting lens attached to said second plate upper face and having a third lens cavity that surrounds said third LED lamp, and a fourth side-emitting lens attached to said cap plate lower face and having a fourth lens cavity that surrounds said fourth LED lamp.

* * * * *